US007780818B2

(12) United States Patent
Cai et al.

(10) Patent No.: US 7,780,818 B2
(45) Date of Patent: Aug. 24, 2010

(54) SUCTION TUBE FOR NONWOVEN MAT MACHINE AND METHOD

(75) Inventors: Yifang Cai, Littleton, CO (US); Mark Allan Granger, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 887 days.

(21) Appl. No.: 11/648,500

(22) Filed: Dec. 28, 2006

(65) Prior Publication Data

US 2008/0159817 A1 Jul. 3, 2008

(51) Int. Cl.
*D21F 1/52* (2006.01)
*D21F 1/48* (2006.01)

(52) U.S. Cl. ..... 162/364; 162/217; 162/363

(58) Field of Classification Search ..... 162/199, 162/272, 274, 278, 279, 363–366, 217; 264/87; 425/85; 271/183; 406/105; 15/300.1, 309.1; 134/21; 34/653
See application file for complete search history.

(56) References Cited

U.S. PATENT DOCUMENTS 592,163 A * 10/1897 Nash ..... 162/366
2,368,662 A * 2/1945 Jordan ..... 162/278
2,544,572 A * 3/1951 Vickery ..... 162/279
2,608,913 A * 9/1952 Bratton ..... 162/365
3,076,492 A * 2/1963 Monks ..... 72/54
3,205,127 A * 9/1965 Erbach ..... 162/363
3,526,017 A * 9/1970 Kleimola ..... 15/308
3,829,927 A * 8/1974 Boyland ..... 15/301
4,002,047 A * 1/1977 MacPhee et al. ..... 72/160
4,112,174 A 9/1978 Hannes et al.
4,191,612 A * 3/1980 Araoka ..... 162/352
4,547,266 A * 10/1985 Keller et al. ..... 162/252
4,595,501 A * 6/1986 Queyroix ..... 210/400
4,681,802 A 7/1987 Gaa et al.
4,810,676 A 3/1989 Gaa et al.

* cited by examiner

*Primary Examiner*—Eric Hug
(74) *Attorney, Agent, or Firm*—Robert D. Touslee

(57) ABSTRACT

A nonwoven fibrous mat or web forming or treating system is disclosed comprising a movable, permeable wire or belt for carrying the fibrous mat or web over at least one suction tube assembly comprising a primary suction tube having a suction slot at the top of the primary suction tube and an exit tube communicating with the primary suction tube mounted beneath the permeable belt to have the suction slot on or close to the bottom surface of the movable belt. The suction slot is at least 3.6 meters long and up to more than 5.3 meters long, and the exit tube of the suction tube assembly communicates with the primary suction tube through an opening in the primary suction tube, the opening being generally centered around a centerline of the suction slot. This primary suction tube assembly provides a more uniform suction distribution along the suction slot and reduces fouling of the suction slot compared with previous suction tube assemblies.

38 Claims, 3 Drawing Sheets

SUCTION TUBE FOR NONWOVEN MAT MACHINE AND METHOD

The invention involves suction tube assemblies for inclined wire, nonwoven, wet mat machines and methods of making nonwoven mats using these suction tubes.

BACKGROUND

Nonwoven mat wet forming machines having a moving, inclined forming wire are known for making all kinds of nonwoven mats from a low concentration of fibers dispersed in a normally aqueous whitewater and it is known to use such machines as manufactured by Voith GmBh, Sandy Hill Corp. and others. Nonwoven mats are used as substrates in the manufacture of a large number of products including roofing of all types, carpet, etc. and also as a facing for products like wallboard, foam board and insulation. Methods of making nonwoven mats using wet laid processes on such machines are described in U.S. Pat. Nos. 4,112,174, 4,681,802, and 4,810,576, the disclosures of which are hereby incorporated herein by reference. In these processes a slurry of glass fiber is made by adding fiber to a typical white water in a pulper to disperse the fiber in the white water forming a slurry having a very low fiber concentration to feed to the above machines where the fibers are deposited on the moving forming wire, a permeable, moving belt, to form a wet web. Excess water is removed from the slurry on the forming wire using one or more suction tube assemblies located beneath the moving forming wire. The dewatered, but still wet, nonwoven web of fiber is then usually transferred to a second moving screen in-line with the forming screen and run through a binder saturating station where an aqueous binder mixture, such as an aqueous acrylic resin based binder mixture, is applied to the mat in any one of several known ways. The mat, saturated with the binder, is then run over one or more additional suction tube assemblies while still on the second moving screen to remove excess binder.

The wet mat is then transferred to a moving wire mesh belt, or a honeycomb drum, and run through an oven to dry the wet mat and to cure (polymerize) the resin based binder to bond the fibers together in the mat. Preferably, the aqueous binder solution is applied using a curtain coater or a dip and squeeze applicator, but other methods of application such as spraying are also known.

In the drying and curing oven the mat is subjected to temperatures up to 450 or even 550 degrees F. or higher for periods usually not exceeding 1-2 minutes and as little as a few seconds.

The wet forming machines have gotten wider and are being run fastest and faster to increase productivity. Due to the low concentration of the fiber slurry, about 0.005 to about 0.02 percent, use a very large pumps to feed the fibrous slurry to the forming box or boxes because of the high degree of dilution needed to keep the fibers well dispersed and to achieve the degree of uniformity of fibrous structure needed for the end use of the nonwoven mats. Therefore, more and more water, and aqueous binder, must be removed by the suction tube assemblies in the forming section and in the binder application section(s) of the wet forming line. On existing machines, the productivity of the mat lines is being hampered by having to shut the machine down to clean lodged fibers from the slots of the suction tubes, fibers that have been passed through the openings in the forming wire. Also, as fiber lodges in the suction slot of the suction tube, this interference begins to vary the basis weight and/or binder content of the mat across the width of the mat. These problems are particularly troublesome when making roofing products or other mats that use longer fibers because the longer fibers tend to hang-up over or around the open slot that is close to or kisses the bottom side of the forming wire. Also, since most of the volume of nonwoven mats is for roofing and roofing being very seasonal with mat inventory being relatively low density and very bulky, an increased mat capacity per line, per crew, per location, etc. would also provide a significant competitive advantage during the peak demand times.

SUMMARY

It has now been discovered that the problem of the prior art suction tube assemblies is with the manner in which an exit tube, a part of the suction tube assemblies, communicates with the primary suction tube. Prior art exit tubes communicated with the primary suction tube through two spaced apart rectangular openings. It has now been discovered that when the two openings are replaced with one longer opening being centered on the primary suction tube, much improved results are achieved. The suction slot does not tend to become cluttered with fibers, and when any fibers do accumulate this occurs only near the ends of the slot where any build-up can be removed without shutting the line down, rather in the center portion of the slot as with prior art suction tube assemblies, where the build-ups were not accessible to the operators unless the line was stopped.

The invention comprises a suction tube assembly that comprises a primary suction tube having a slot opening in its top portion that is at least about 3.6 meters long, and an exit tube that communicates with a suction pump or fan, the exit tube communicating with the primary suction tube, the improvement comprising that the exit tube communicates with the primary suction tube through one opening centered on a longitudinal center line of the suction slot. The importance of and savings produced by the invention becomes even greater as the width of the forming wire and the length of the suction slot in the suction tube increases, such as lengths like 4 meters, 5 meters, 5.3meters, 6 meters and longer.

The invention also includes a nonwoven fibrous mat or web forming or treating system comprising a movable, permeable belt for carrying the fibrous mat or web and at least one suction tube assembly comprising a primary suction tube having a suction slot at the top of the primary suction tube and an exit tube communicating with the primary suction tube, the suction tube assembly mounted beneath the movable belt to have the suction slot on or close to the bottom surface of the movable belt, the improvement comprising that the suction slot is at least 3.6 meters long and up to at least 6 meters long and that the exit tube communicates with the primary suction tube through an opening that is generally centered around the centerline, perpendicular to the length of the suction slot, of the suction slot. By generally centered is meant that the centerline of the length of the opening is within about 15, more typically about 10 and even more typically about 3 centimeters of centerline, perpendicular to the length of the suction slot, of the suction slot. Most typically, the centerline of the opening is aligned with the centerline of the slot. The diameter of the suction tube is typically at least about 0.6 meters and the diameter of the exit tube is typically less than about 0.6 meters. The shape of the opening that communicates between the primary suction tube and the exit tube can be of any practical shape having one dimension longer than the other dimension including a rectangle, an oval and similar shapes. The width of the opening should be at least about 6+/2, more typically 6+/−1 and most typically 6+/−0.5 times the height of the opening. The area of the opening typically is 3.6+/−0.3, more typically 3.67+/−0.2 or 3.6+/−0.2, even more typically 3.6+/−0.1 and most typically is 3.6+/−0.08 times the area of the slot in the primary suction tube.

The invention also includes a nonwoven fibrous mat or web forming or treating system comprising a movable, permeable belt for carrying the fibrous mat or web and at least one suction tube assembly comprising a primary suction tube having a suction slot at the top of the primary suction tube and an exit tube communicating with the primary suction tube, the suction tube assembly mounted beneath the movable belt to have the suction slot on or close to the bottom surface of the movable belt, the improvement comprising that the suction slot is at least 3.6 meters long and up to at least 6 meters long and that the exit tube communicates with the primary suction tube through an opening that is generally centered around the centerline, perpendicular to the length of the suction slot, of the suction slot. By generally centered is meant that the centerline of the length of the opening is within about 15, more typically about 10 and even more typically about 3 centimeters of centerline, perpendicular to the length of the suction slot, of the suction slot Most typically, the centerline of the opening is aligned with the centerline of the slot. The diameter of the suction tube is typically at least about 0.6 meters and the diameter of the exit tube is typically less than about 0.6 meters. The shape of the opening that communicates between the primary suction tube and the exit tube can be of any practical shape having one dimension longer than the other dimension including a rectangle, an oval and similar shapes. The width of the opening should be at least about 6+/−2, more typically 6+/−1 and most typically 6+/−0.5 times the height of the opening. The area of the opening typically is 3.6+/−0.3, more typically 3.67+/−0.2 or 3.6+/−0.2, even more typically 3.6+/−0.1 and most typically is 3.6+/−0.08 times the area of the slot in the primary suction tube.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION

Figure 1:
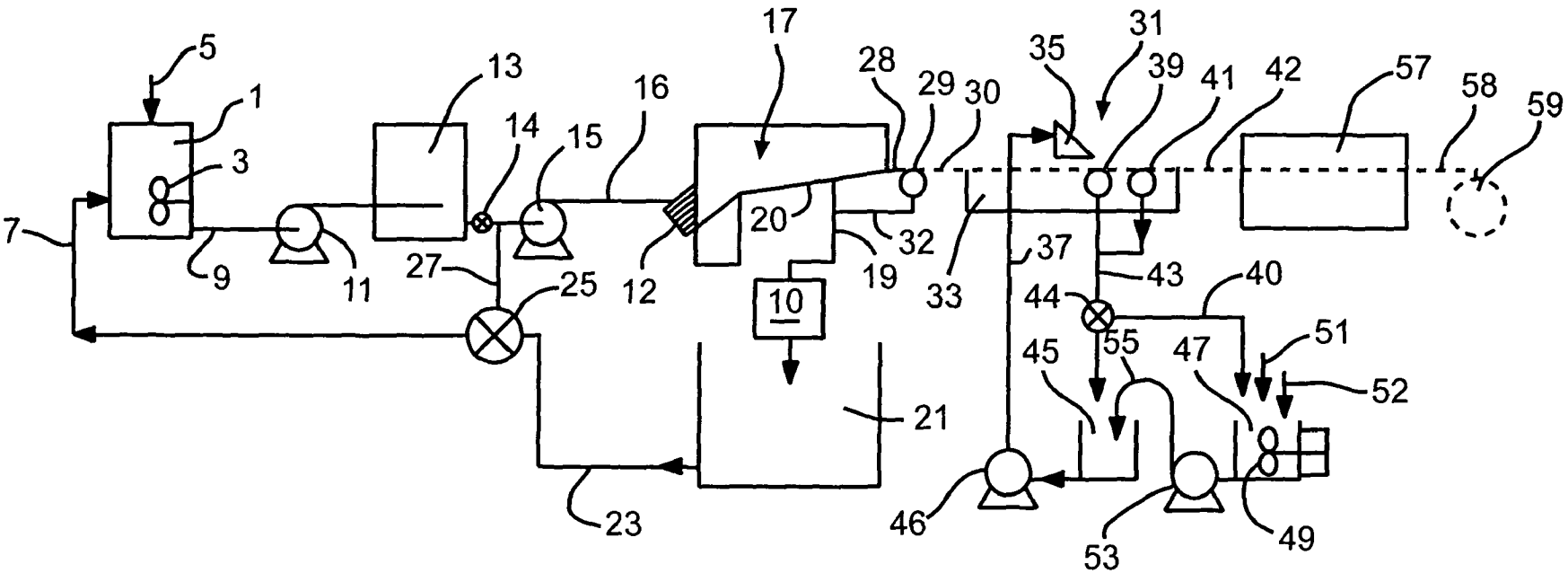
FIG. 1 (PRIOR ART)
FIG. 1 is a schematic drawing of a typical wet forming system used in the practice of the invention.

FIG. 1 is a schematic of a typical prior art wet former system for making multi-layer nonwoven mats except that it contains two stock preparation systems. Fibers, particulate or both 5 are fed, typically continuously, but batch type preparation is also used, into a pulper 1 containing forming liquid, usually a known aqueous forming liquid flowing in a return pipe 7. Mixing takes place in the pulper 1 with an agitator 3 to form a relatively concentrated slurry that exits the pulper 1 through pipe 9 and into a pump 11 that pumps the concentrated slurry into a holding tank 13. The forming liquid is delivered to pipe 7 by pump 25, pumping the forming liquid coming from a pipe 23 and a deairing tank 21. Concentrated slurry is metered out of the holding tank 13 by a pump 15 and variable flow valve 14 where the concentrated slurry is diluted substantially with the forming liquid coming through pipe 26 to a forming pump 27. The substantially diluted slurry, usually having a solids concentration of less than about 0.04 percent, flows through pipe 16 to a distribution manifold 12 on a forming box 17.

The slurry flows toward a moving permeable forming belt 20 where the fibers and any particulates in the slurries are formed into a wet, nonwoven web while the forming water flows through the forming belt as return forming liquid 19 and onto the deairing tank 21. A final suction tube assembly 29 under the forming belt 20 near where the wet web is removed from the forming belt 20 removes excess forming liquid from the wet web and returns it through pipe 32 to the deairing tank 21. The wet web is then transferred to a second moving permeable belt **30*d* that carries the wet web under a binder applicator 35 where binder is applied in a binder application section 31. Excess binder is removed from the wet web or mat with suction tube assemblies 39 and 41 to deduce the binder level in the mat to the desired level. The bindered mat is then transferred to an oven belt 42 and passed through an oven 57 where the mat is dried and the resin(s) in the binder cured. The dry mat 58 can then be wound into a roll 59** for packaging, shipment and use or storage.

The mat is bound together with a resinous binder in a known manner. The binder is usually an aqueous mixture of water and one or more resins or polymers and other additives in a solution, emulsion or latex as is known. The binder is prepared by adding one or more resinous materials 51 with a liquid 52, normally water, to a mix tank 47 containing an agitator 49. Excess binder removed from the bindered mat with suction boxes 39 and 41 can also be added to the mix tank 47 by way of return pipe 43. The mixed binder is then pumped with pump 53 to a binder holding tank 45 to supply a binder applicator pump 46 that meters the binder at the desired rate using variable valve 44 to the binder applicator 35.

Figure 2:
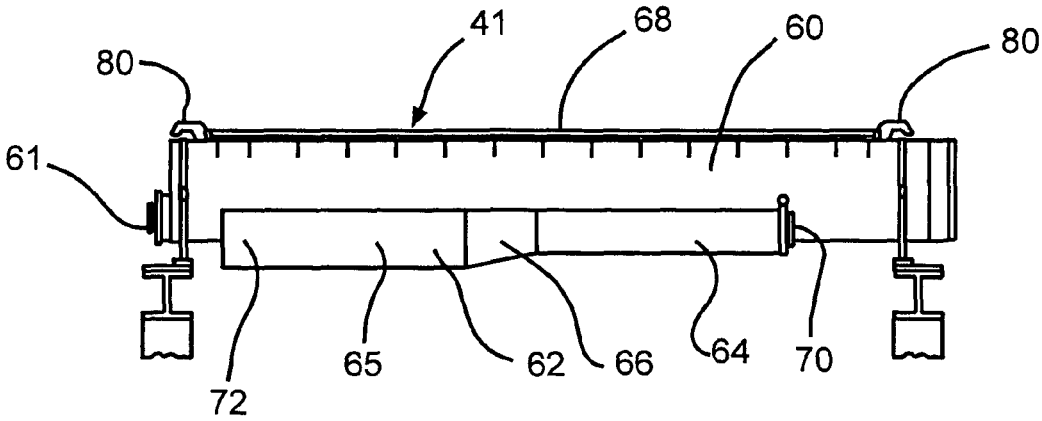
FIG. 2 (Prior Art)
FIG. 2 is a front view of a prior art suction tube assembly.
Figure 3:
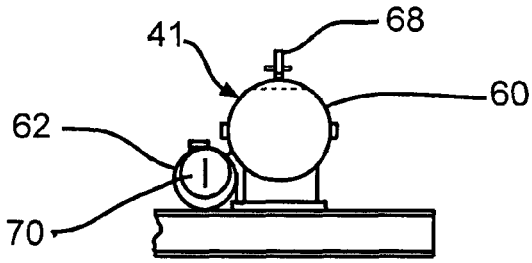
FIG. 3 (Prior Art)
FIG. 3 is an end view of a prior art suction tube assembly.
Figure 4:
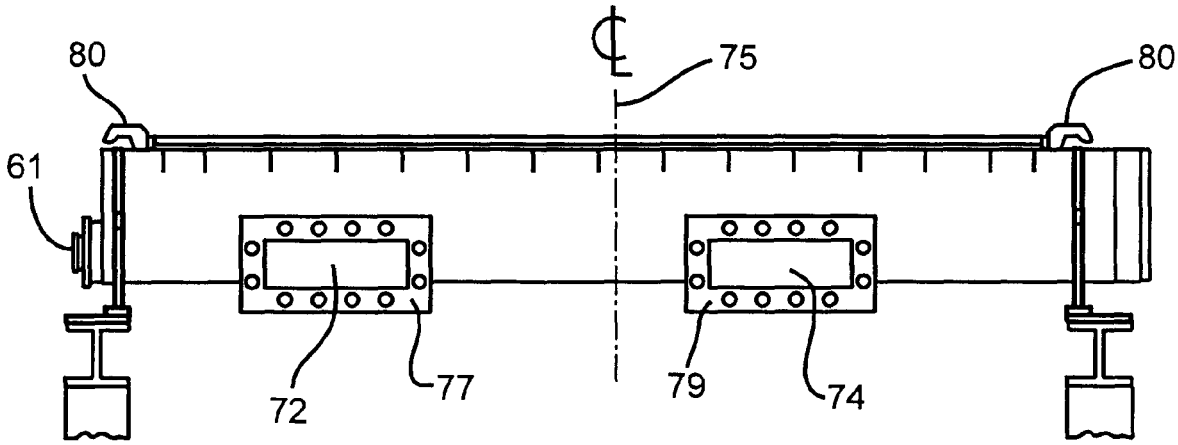
FIG. 4 (Prior Art)
FIG. 4 is a front view showing the suction tube assembly in FIG. 2, but with an exit tube removed.

FIG. 2 shows a typical prior art suction tube assembly used in the system shown in FIG. 1. This suction tube assembly 41 (also at positions 29 and 39 in FIG. 1) comprises a primary suction tube 60, having an inspection cap 61 on at least one end and a suction slot 68 at the top of the primary suction tube 60, and an exit tube 62. The exit tube 62 can be a single tube, but typically comprises a small diameter section 64, a larger diameter section 65 and a transition section 66, designed to try to achieve a consistent suction magnitude or negative pressure across the length of the suction slot 68 at the top of the primary suction tube 60. The exit tube 62 also comprises a clean-out cap 70 at one end and a suction end 72 at the opposite end that communicates with a suction pump or fan 10 shown in FIG. 1. As shown in FIG. 4, the exit tube 62 communicates with the primary suction tube 60 through two rectangular openings 72,74, the first opening 72 joining the larger diameter section 65 of the exit tube 62 and the second opening 74 joining the smaller diameter section 64 of the exit tube 62 to the primary suction tube 60. The first opening 72 is spaced from the centerline 75 of the primary suction tube 60 and the second opening is also spaced from the center line 75, but on the opposite side of the centerline 75 from the first opening 72. The openings 72,74 are surrounded with optional flanges 77,79 to permit easy removal of the exit tube 62 from the primary suction tube 60, but other means of connecting the two parts can be used.

The forming wire runs over the top of the suction slot 68 and between the guides 80 at each end of the suction slot 68. As the line speed has increased above about 300 to 365 meters/minute (MPM) and also as the width of the forming box, etc. has exceeded about 3.65 meters, or a combination of higher line speed and forming width has increased beyond about 1100 to 1330 square meters/minute, problems have developed with the suction tube assemblies. The suction slot 68 began to become fouled much more often and the fouling seemed to occur most often in the center portion of the suction slot 68, requiring that the line be shut down to clean the suction tube assembly 41, and also the other suction tube assemblies on the line while the line was shut down. Cleaning of the suction tube assembly involves shutting the line down and going in under the forming wire with a tool to remove fibers and clumps of fibers that have built up in and around the suction slot 68 and normally takes more than 10 minutes from run time to run time. Production time is lost during this time and during the first several to many minutes after start up of the line, the line is making scrap until the line is back in equilibrium meeting product specifications. To insure that good product, product in specifications, is being made after start-up, enough material must be wound to make a good doff, transferring the mat to a new mandrel to start a new roll, and material from the first mandrel must then be sampled and tested. If this material is not in specification, another doff must be done, etc. until in spec. material is confirmed. This wastes production time, is very costly and generates a lot of scrap, and the wider the machine the more likely or frequent the suction slot fouling and the greater the losses. Every shut down of the line to clean a suction tube assembly 41, etc. is extremely expensive.

It was discovered that the problem causing the fouling of the suction slot 68 was due to the manner in which the exit tube 62 communicated with the primary suction tube 60. It was also discovered that if the manner of communication was changed to a larger area opening generally centered on the centerline of the primary suction tube, that fouling of the suction slot was greatly reduced or essentially eliminated.

Figure 5:
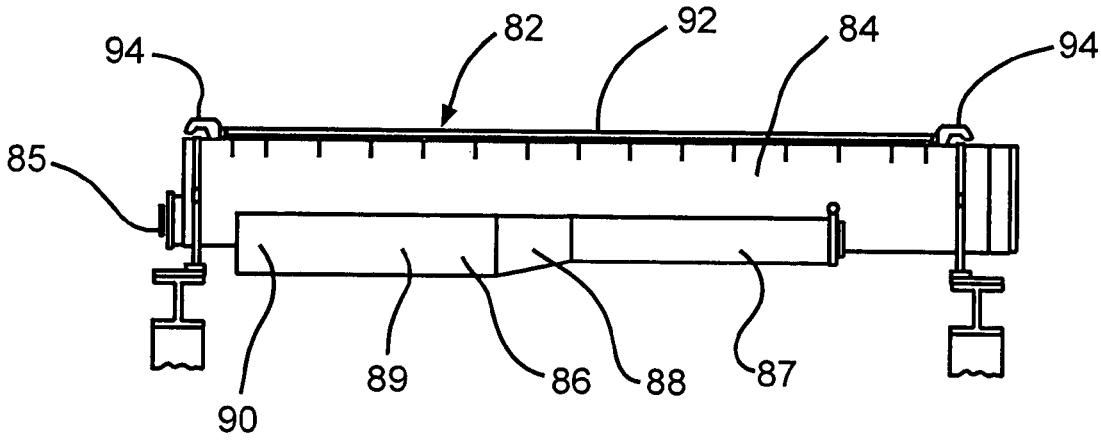
FIG. 5 is a front view of a suction tube assembly of the invention.
Figure 6:
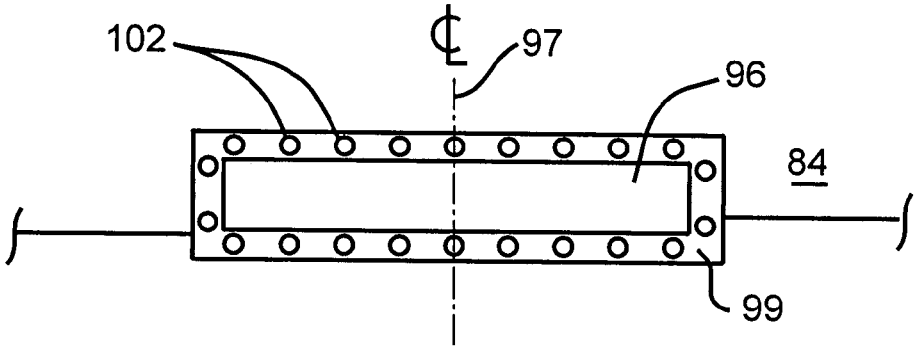
FIG. 6 is a front view of the suction tube assembly of the invention with the exit tube removed.
Figure 7:
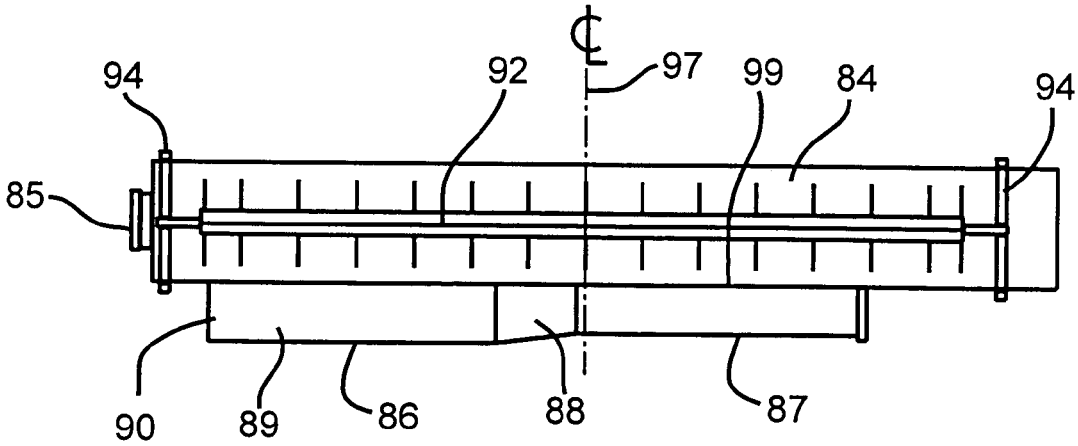
FIG. 7 is a plan view of the suction tube assembly of the invention.

FIGS. 5-7 show one embodiment of a suction tube assembly made according to the invention. The suction tube assembly 82 shown in FIG. 5 is comprised of a primary suction tube 84 having an inspection port 85, an exit tube 86 having a smaller diameter section 87, a larger diameter section 89 and a transition section 88 therebetween and an exit end 90 that communicates with a suction pump or fan (not shown, but similar to that shown in FIG. 1 as suction pump or fan 10. The primary suction tube 84 also has a suction slot 92 at its top that measures about 5.3 meters long by about 12-13 mm wide with a guide 94 at each end of the suction slot 92. The exit tube 86 communicates with the primary suction tube 84 through a contained opening 96 that is centered around the longitudinal centerline 97 of the primary suction tube 84. The opening 96 measures 1.22 meters long by about 0.2 meters high. The area of the opening 96 is about 3.67 times the area of the slot 92, but this ratio can vary up to about 3.97 and down to about 3.37. An optional flange 99 on a short duct (not shown) surrounds the opening 96 for bolting the exit tube 86 onto a like, optional, flange (not shown) on a duct emerging from the primary suction tube 84, but the exit tube 86 can be connected to the primary suction tube 84 in many other ways including a welded duct, a flexible hose attached with clamps to duct outlets on the primary suction tube 84 and exit tube 86 and with a flange clamp instead of bolts. Of course, an appropriate gasket should be used on the flange 99 having bolt holes 102 therein as is known. By contained opening is meant that the opening is defined by an enclosure of any reasonable shape cross section including a rectangle, square, oval, rectangle with radiused corners, trapezoid, circle, square, etc.

Different embodiments employing the concept and teachings of the invention will be apparent and obvious to those of ordinary skill in this art and these embodiments are likewise intended to be within the scope of the claims. For example, while the invention is described as comprising a primary suction tube and an exit tube, the cross sectional shape perpendicular to the length of either or both of these members need not be round, but can also be of any reasonable shape including square, rectangular, oval, triangular, trapezoidal, U shaped, etc. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A suction tube for mounting beneath a permeable belt on a wet forming machine or a binder application section, the suction tube comprising a tube, a suction slot in a top portion of the tube, the suction slot located to be in contact with a permeable forming wire or a binder section permeable wire and the length of the suction slot being at least 3.6 meters long, the suction tube having one opening in one side of the suction tube, the opening having a shape having one dimension longer than the other dimension with the width of the opening being at least about 4 to 8 times the height of the opening and at least about 20 percent of the length of the suction slot, a centerline, perpendicular to the length of the suction tube, of the opening being generally aligned, within about 15 cm, with a centerline, perpendicular to the length of the suction slot, of the suction slot, the area of the opening being about 3.67+/−0.3 times the area of the suction slot.

2. The suction tube of claim 1 wherein the opening centerline is within about 10 cm of the centerline of the suction slot.

3. The suction tube of claim 1 wherein the opening centerline is within about 3 cm of the centerline of the suction slot.

4. The suction tube of claim 1 wherein the opening centerline is aligned with the centerline of the slot.

5. The suction tube of claim 1 wherein the shape of the opening is a rectangle.

6. The suction tube of claim 2 wherein the shape of the opening is a rectangle.

7. The suction tube of claim 3 wherein the shape of the opening is a rectangle.

8. The suction tube of claim 2 wherein the shape of the opening is a rectangle.

9. The suction tube of claim 4 wherein the shape of the opening is an oval and the length of the opening is about 6+/−2 times the height of the opening.

10. The suction tube of claim 6 wherein the length of the opening is about 6+/−1 times the height of the opening.

11. The suction tube of claim 7 wherein the length of the opening is about 6+/−0.5 times the height of the opening.

12. The suction tube of claim 8 wherein the length of the opening is about 6 times the height of the opening.

13. The suction tube of claim 1 wherein the area of the opening is about 3.6+/−0.2 times the area of the suction slot.

14. The suction tube of claim 2 wherein the area of the opening is about 3.6+/−0.2 times the area of the suction slot and the length of the suction slot is at least about 4 meters.

15. The suction tube of claim 3 wherein the area of the opening is about 3.6+/−0.1 times the area of the suction slot and the length of the suction slot is at least about 5 meters.

16. The suction tube of claim 4 wherein the area of the opening is about 3.6+/−0.08 times the area of the suction slot and the length of the suction slot is at least about 5 meters.

17. A suction tube for mounting beneath a permeable belt on a wet forming machine or a binder application section for forming or treating a mat or web containing glass fibers, the suction tube comprising a tube, a suction slot in a top portion of the tube, the suction slot located to be in contact with a permeable forming wire or a binder section permeable wire and the length of the suction slot being at least about 4 meters long, the suction tube having one rectangular opening in one side of the suction tube, the rectangular opening having a width at least about 4 to 8 times the height of the opening and at least about 20 percent of the length of the suction slot, a centerline, perpendicular to the length of the rectangle, of the opening being within 3 cm of a centerline, perpendicular to the length of the suction slot, of the suction slot, the area of the opening being about 3.67+/−0.1 times the area of the suction slot, and an exit tube being along side of the suction tube, the exit tube communicating with a suction pump or fan through an exit end of the exit tube near an end of the suction tube, the exit tube communicating with the suction tube through said opening.

18. The suction tube of claim 17 wherein the suction slot is about 5.3 meters long, the centerline of the opening is aligned with the centerline of the suction slot and the area of the opening is about 3.6 times the area of the suction slot.

19. A nonwoven mat or web forming or treating system for making the mat or web from a slurry containing glass fibers, the system comprising at least one movable, permeable wire or belt for carrying the fibrous mat or web and at least one suction tube assembly comprising a primary suction tube having a suction slot at the top of the primary suction tube, and an exit tube communicating with the primary suction tube through one opening in the primary suction tube and a second opening in the exit tube, the exit tube being along side of the primary suction tube, the exit tube also communicating with a suction pump or fan through an exit opening in the exit tube, the exit opening being near an end of the suction tube, the suction tube assembly mounted beneath the at least one movable, permeable wire or belt to have the suction slot on or close to the bottom surface of the movable, permeable wire or belt, wherein the suction slot is at least 3.6 meters long and a centerline of the opening in the primary suction tube, perpendicular to the length of the opening, being generally aligned with the a centerline, perpendicular to the length of the suction slot, the area of the opening in the primary suction tube being about 3.6+/−0.3 times the area of the suction slot, the opening in the primary suction tube having a width at least about 4 to 8 times the height of the opening and at least about 20 percent of the length of the suction slot.

20. The mat or web forming or treating system of claim 19 wherein the opening centerline is within about 10 cm of the centerline of the slot.

21. The mat or web forming or treating system of claim 19 wherein the opening centerline is within about 3 cm of the centerline of the slot and the length of the suction slot is at least about 5 meters.

22. The mat or web forming or treating system of claim 19 wherein the opening centerline is aligned with the centerline of the slot and the length of the suction slot is at least about 5 meters.

23. The mat or web forming or treating system of claim 19 wherein the shape of the opening in the primary suction tube is a rectangle.

24. The mat or web forming or treating system of claim 20 wherein the shape of the opening in the primary suction tube is a rectangle.

25. The mat or web forming or treating system of claim 21 wherein the shape of the opening in the primary suction tube is a rectangle.

26. The mat or web forming or treating system of claim 22 wherein the shape of the opening in the primary suction tube is a rectangle.

27. The mat or web forming or treating system of claim 23 wherein the length of the opening in the primary suction tube is about 6+/−1 times the height of said opening.

28. The mat or web forming or treating system of claim 24 wherein the length of the slot is at least about 4 m and the length of the opening in the primary suction tube is about 6+/−1 times the height of said opening.

29. The mat or web forming or treating system of claim 25 wherein the length of the opening in the primary suction tube is about 6+/−0.5 times the height of said opening.

30. The mat or web forming or treating system of claim 26 wherein the length of the opening in the primary suction tube is about 6 times the height of said opening.

31. The mat or web forming or treating system of claim 19 wherein the area of the opening in the primary suction tube is about 3.6+/−0.2 times the area of the suction slot and the length of the suction slot is at least about 4 meters.

32. The mat or web forming or treating system of claim 20 wherein the area of the opening in the primary suction tube is about 3.6+/−0.1 times the area of the suction slot and the length of the suction slot is at least about 5 meters.

33. The mat or web forming or treating system of claim 21 wherein the area of the opening is about 3.6+/−0.1 times the area of the suction slot and the length of the suction slot is at least about 5 meters.

34. The mat Or web forming or treating system of claim 22 wherein the area of the opening is about 3.6+/−0.08 times the area of the suction slot and the length of the suction slot is at least about 4 meters.

35. A nonwoven mat or web forming or treating system for making the mat or web from a slurry containing glass fibers, the system comprising at least one movable, permeable wire or belt for carrying the fibrous mat or web and at least one suction tube assembly comprising a primary suction tube having a suction slot at the top of the primary suction tube, and an exit tube communicating with the primary suction tube through one rectangular opening in the primary suction tube and a second opening in the exit tube, the exit tube being along side of the primary suction tube, the exit tube also communicating with a suction pump or fan through an exit opening in the exit tube, the exit opening being near an end of the suction tube, the suction tube assembly mounted beneath the at least one movable, permeable wire or belt to have the suction slot on or close to the bottom surface of the movable, permeable wire or belt, wherein the suction slot is at least 5 meters long and a centerline of the rectangular opening in the primary suction tube, perpendicular to the length of the opening, being within about 3 cm of a centerline, perpendicular to the length of the suction slot, the area of the opening in the primary suction tube being about 3.67+/−0.1 times the area of the suction slot, the opening in the primary suction tube having a width at least about 4 to 8 times the height of said opening and at least about 20 percent of the length of the suction slot.

36. The mat or web forming or treating system of claim 35 wherein the suction slot is about 5.3 meters long, the centerline of the opening is aligned with the centerline of the suction slot and the area of the opening is about 3.67 times the area of the suction slot.

37. A method of forming or treating a wet nonwoven fibrous web or mat comprising glass fibers on a moving, permeable belt on a forming or treating system comprising forming a fibrous web or mat on a movable, permeable wire or belt, moving the wire or belt to carry the wet fibrous mat or web over the top of at least one suction tube assembly comprising a primary suction tube having a suction slot at the top of the primary suction tube and an exit tube communicating with the primary suction tube, the suction tube assembly mounted beneath the movable wire or belt to have the suction slot on or close to the bottom surface of the movable wire or belt, and drying and curing the web or mat to form a nonwoven fibrous mat, wherein the suction slot is at least 3.6 meters long and that the exit tube communicates with the primary suction tube through one opening in the primary suction tube that is generally centered, within about 15 cm, of a centerline, perpendicular to the length of the suction slot, of the suction slot, the area of the opening in the primary suction tube being about 3.6+/−0.3 times the area of the suction slot, the opening having a shape having one dimension longer than the other dimension with the width of the opening being at least about 4 to 8 times the height of the opening, the exit tube being along side of the primary suction tube, the exit tube communicating with a suction pump or fan through an exit end of the exit tube, near an end of the primary suction tube.

38. The method of claim 37 wherein the length of the suction slot is at least about 5 meters, the opening in the primary suction tube is rectangular with the length of the rectangle being about 6+/−0.5 times height of the rectangle and the area of the opening is about 3.6+/−0.08 times the area of the suction slot.

* * * * *